United States Patent [19]

Sato et al.

[11] Patent Number: 4,909,304

[45] Date of Patent: Mar. 20, 1990

[54] ENDLESS TRACK TYPE CONTINUOUS CASTING MACHINE

[75] Inventors: Hisashi Sato; Shiro Osada; Shuzo Takahashi, all of Yokohama; Yutaka Tsuchida, Yokosuka; Nobuhisa Hasebe, Yokohama, all of Japan

[73] Assignees: Ishikawajima-Harima Jukogyo Kabushiki Kaisha; Nippon Kokan Kabushiki Kaisha, both of Japan

[21] Appl. No.: 262,478

[22] Filed: Oct. 25, 1988

[30] Foreign Application Priority Data

Nov. 17, 1987 [JP] Japan ..... 62-289823

[51] Int. Cl.[4] ..... B22D 11/06

[52] U.S. Cl. ..... 164/430; 164/481

[58] Field of Search ..... 164/430, 431, 432, 436, 164/481, 491

[56] References Cited

U.S. PATENT DOCUMENTS 3,426,836 2/1969 Dietrich et al. ..... 164/481
4,505,319 3/1985 Kimura ..... 164/432

FOREIGN PATENT DOCUMENTS 61-154744 7/1986 Japan ..... 164/432
61-180652 8/1986 Japan ..... 164/432

*Primary Examiner*—Richard K. Seidel
*Assistant Examiner*—Rex E. Pelto

[57] ABSTRACT

Downward force resulting from the block mold and its carrier of the upper mold assembly which move downwardly toward the upstream end of the mold cavity defined by the vertically spaced-apart upper and lower mold assemblies is transmitted to the block mold and its carrier of the upper mold assembly passing the upward path extending upwardly from the downstream end of the mold cavity so that the distortions of the cross-sectional configuration and size of the mold cavity due to the weight of the block molds and their carriers are prevented.

2 Claims, 7 Drawing Sheets

ENDLESS TRACK TYPE CONTINUOUS CASTING MACHINE

BACKGROUND OF THE INVENTION

The present invention relates to an endless track type continuous casting machine capable of preventing distortions in cross-sectional configuration and size of a mold cavity due to weight of block molds and their carriers.

Referring first to FIG. 1, a conventional endless track type continuous casting machine will be described. A plurality of block molds 1 are interconnected in the form of an endless track to define a mold assembly 2. A pair of such mold assemblies 2 are disposed in vertically opposing relationship to define a mold cavity 3. A tundish nozzle 5 extends from a bottom of a tundish 4 into an upstream opening of the mold cavity 3. Reference numeral 6 denotes driving rolls; 7, idle rolls; and 8, a casting.

According to the continuous casting machine with the above-described construction, melt is poured into the tundish 4 and is supplied through the tundish nozzle 5 into the mold cavity 3 defined between the upper and lower mold assemblies 2 which are moved in the same direction by the driving and idle rolls 6 and 7. Melt is cooled by the block molds 1 to solidify into a casting 8 which is discharged out of the continuous casting machine.

With the continuous casting machine of the type described above, a cooling zone of each mold assembly 2 is limited to the return path of the mold assembly 2 which is relatively short in length so that the block molds 1 are not sufficiently cooled when they return to the upstream opening of the mold cavity 3, resulting in a fear of failure in continuous casting operation.

In view of the above, the inventors have recently proposed a continuous casting machine as shown in FIGS. 2–6 having sufficiently long cooling zones.

More specifically, a pair of upper and lower mold assemblies 2 each comprising a plurality of block molds 1 interconnected in the form an endless track are disposed in vertically opposing relationship to define the mold cavity 3. Inclined and horizontal cooling zones 9 and 10 which are relatively long in length are defined between downstream and upstream openings of the mold cavity 3 for each of the mold assemblies 2 as shown in FIG. 2. Each mold assembly 2 is driven by gears 12 drivingly coupled to a mold-assembly driving system and is braked at the downstream portion of the mold cavity 3 through a gear 13. Such braking of the mold assembly 2 contributes to preventing melt from leaking through gaps between the block molds 1 produced in the mold assembly moving in the path defining the mold cavity 3.

As shown in FIGS. 3–5, each block mold 1 is securely joined to a carrier 14 which has at its either side racks 15 in mesh with the gears 12 and 13 and furthermore has at its either side two wheels 16 for engagement with the gear 12' as shown in FIG. 5.

One of the two wheels 16 is directly supported by the carrier 14 through a shaft 17 while the other wheel 16 is indirectly supported through a shaft 17 by a bearing box 19 fitted into a groove 18 defined in the carrier 14 for sliding movement in the direction of the movement of the block molds 1.

More specifically, the shaft 17 which is directly supported by the carrier 14 is mounted with a bearing box 19 which is the same in construction with the bearing box 19 described above and which is slidably fitted into a groove 18 of a backward or forward adjacent carrier 14. The shaft 17 which is supported through the bearing box 19 by the carrier 14 is directly supported by its backward or forward adjacent carrier 14. Thus, the carriers 14 are sequentially interconnected in the manner described so that the block molds 1 are interconnected in the form of an endless track as described above. Each frame 20 is formed with an endless-track-like groove 21 into which the wheels 16 are rotatably fitted.

In FIGS. 3 and 4, reference numeral 22 represents motors for driving the endless track type mold assemblies 2; 23, brakes; and 24, a side dam block interposed between the upper and lower opposing block molds 1 and adapted to move in synchronism with the block molds 1.

In operation, the motors 22 are energized to drive the block molds 1 through the gears 12 and the racks 15 while the side dam blocks 24 are also driven in synchronism with their corresponding block molds 1. Furthermore, the brakes 23 are energized to brake the mold assemblies 2 through the gears 13 and the racks 15 such that no gap is produced between the adjacent block molds 1 which define the mold cavity 3. In this case, the wheels 16 roll in the grooves 21 so that the mold assemblies 2 are smoothly driven.

Melt in the tundish 4 is supplied through the tundish nozzle 5 into the mold cavity 3 and is cooled by the block molds 1 to solidify into the casting 8 which in turn is discharged out of the continuous casting machine. The mold assemblies 2 are cooled by any means in the cooling zones 9 and 10 and the cooled block molds 1 of the mold assemblies 2 return to the upstream opening of the mold cavity 3.

As described above, the continuous casting machine shown in FIGS. 2–6 has the cooling zones 9 and 10 which are relatively long in length so that the block molds 1 can be satisfactorily cooled until they return to the upstream opening of the mold cavity 3 and consequently the continuous casting operation is not adversely affected.

The conventional endless track type continuous casting machines described above has, however, a problem that the horizontal molding surface of the mold cavity 3 tends to depend downwardly since the upper mold assembly 2 has the inclined cooling zone 9 and a vertical preheating and drying zone 11 which are relatively long in length and also heavy in weight. In addition, the fact that the adjacent carriers 14 are spaced apart from each other for absorption of thermal expansions and the adjacent block molds 1 are in close contact with each other for prevention of leakage of melt results in that downward force (driving force and weight) of the vertical run of the mold assembly 2 is transmitted as pressing force through the contact surfaces of the block molds 1 and consequently the block molds 1 may be damaged when the pressing force becomes greater. Furthermore, it is difficult to maintain a desired degree of flatness of the block mold 1 and the carrier 4; that is, they tend to be inclined since the block mold 1 receives moment $M=FH$ where F is the pressing force exerted when the mold is driven and H is the height from the loading point to the wheel 16 (See FIG. 6) and there exits a gap G between the wheel 16 and the groove 18 as shown in FIG. 3 or 4. Because of these problems, there is a fear that a desired cross-sectional configuration and size of the mold cavity 3 cannot be maintained.

In view of the above, a primary object of the present invention is to prevent the distortions in cross-sectional configuration and size of the mold cavity due to the weight of the block molds and their carriers.

The above and other objects, effects, features and advantages of the present invention will become more apparent from the following description of a preferred embodiment thereof taken in conjunction with the accompanying drawings.

BRIEF DESCRIPTION OF THE DRAWINGS

The same reference numerals are used to designate similar part throughout the figures.

DETAILED DESCRIPTION OF THE PREFERRED EMBODIMENT

Figure 1:
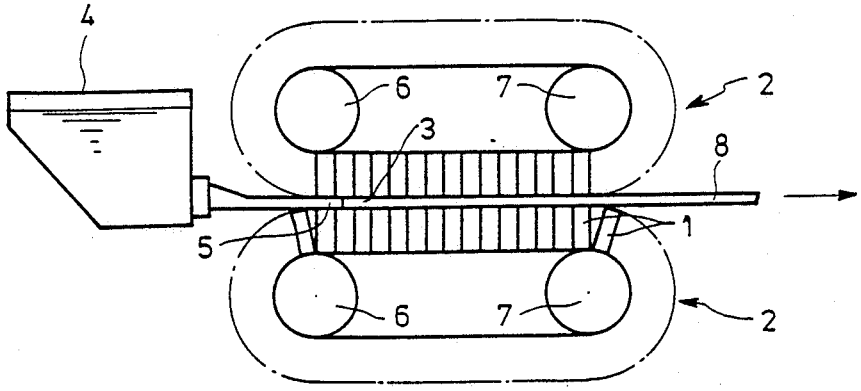
Fig. 1 PRIOR ART
FIG. 1 is a view used to explain a conventional endless track type continuous casting machine.
Figure 2:
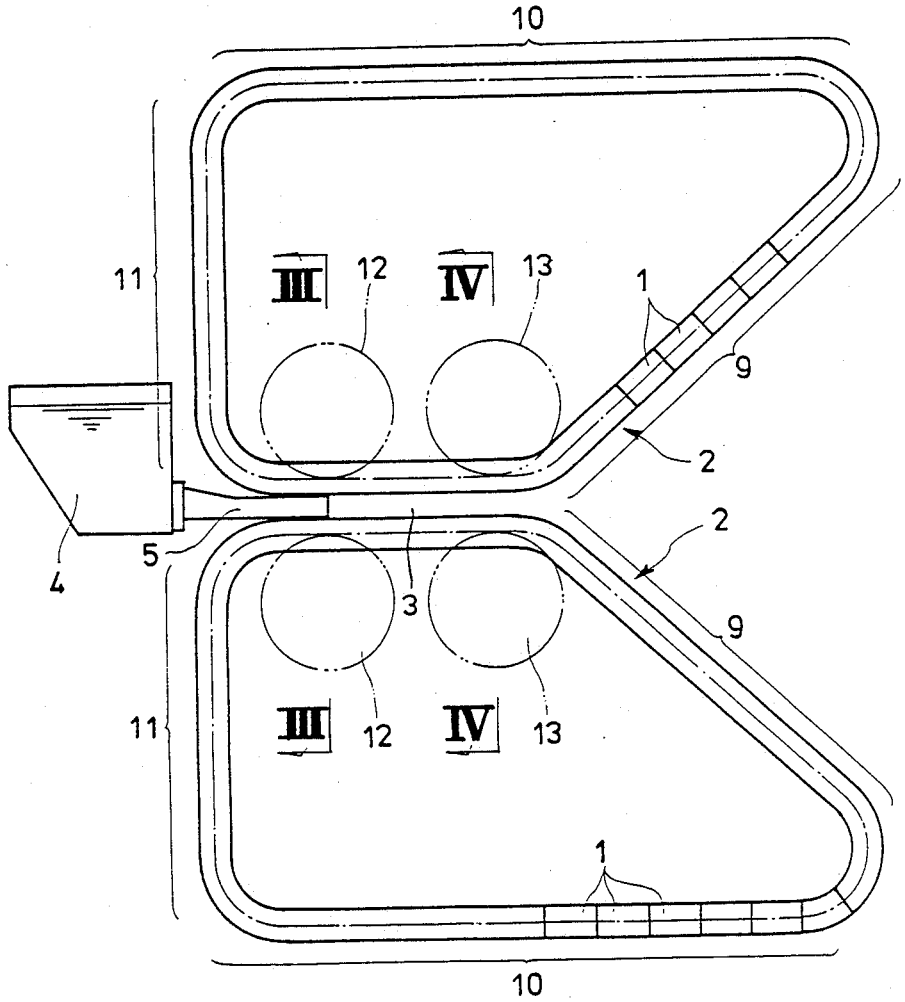
Fig. 2 PRIOR ART
FIG. 2 is a view used to explain an endless track type continuous casting machine so designed and constructed as to solve the problems encountered in the continuous casting machine shown in FIG. 1.
Figure 3:
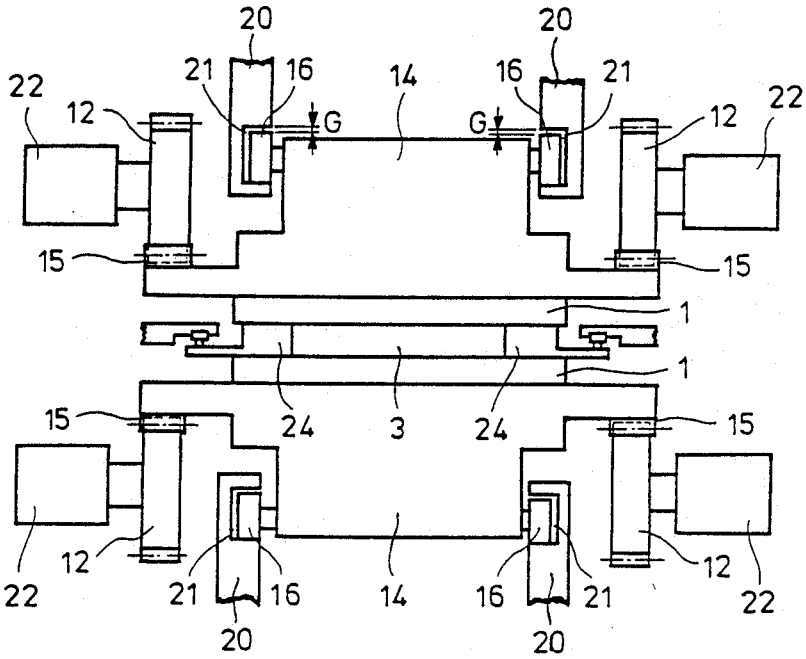
Fig. 3 PRIOR ART
FIG. 3 is a sectional view taken along the line III—III in FIG. 2.
Figure 4:
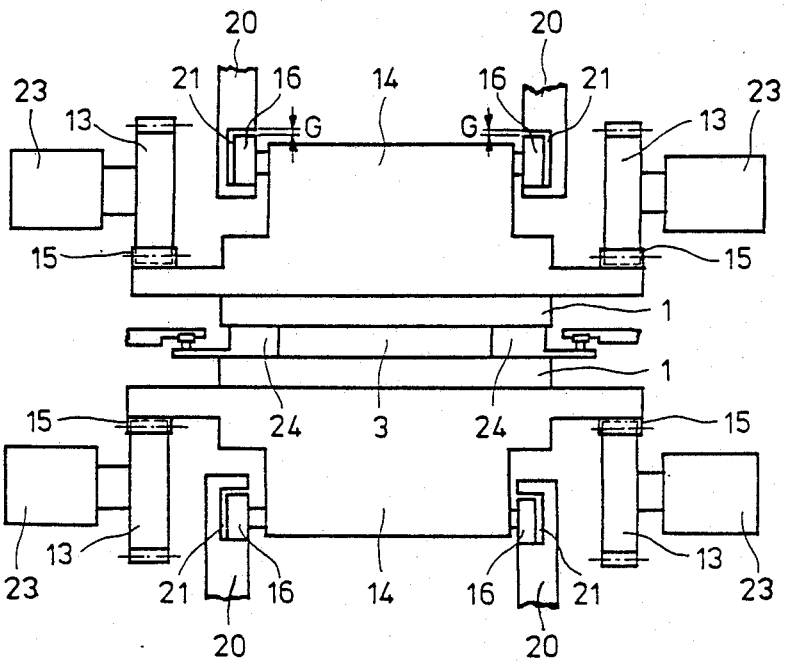
Fig. 4 PRIOR ART
FIG. 4 is a sectional view taken along the line IV—IV in FIG. 2.
Figure 5:
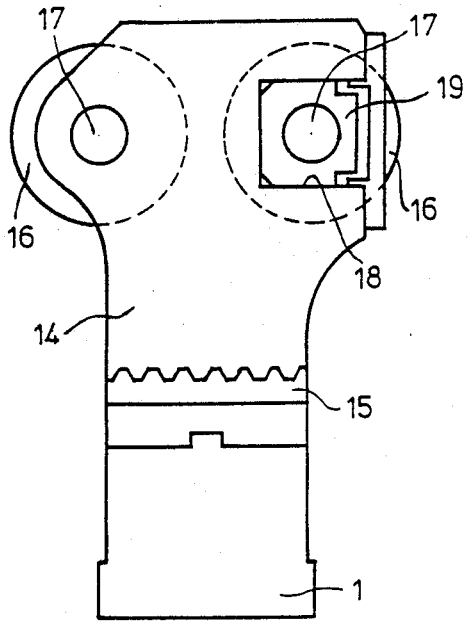
Fig. 5 PRIOR ART
FIG. 5 is a detailed view of a block mold and its carrier to be used in the endless track type continuous casting machine shown in FIG. 2.
Figure 6:
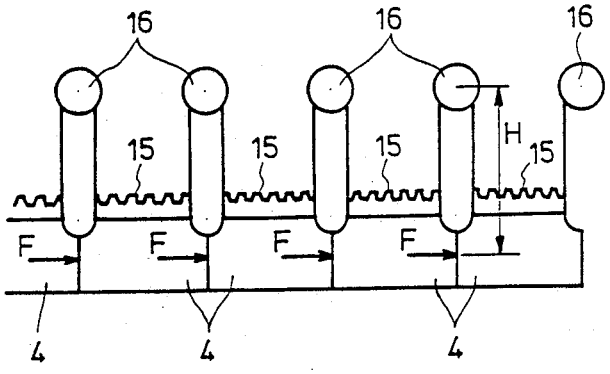
Fig. 6 PRIOR ART
FIG. 6 is a view used to schematically explain the arrangement of the block molds and their carriers.
Figure 7:
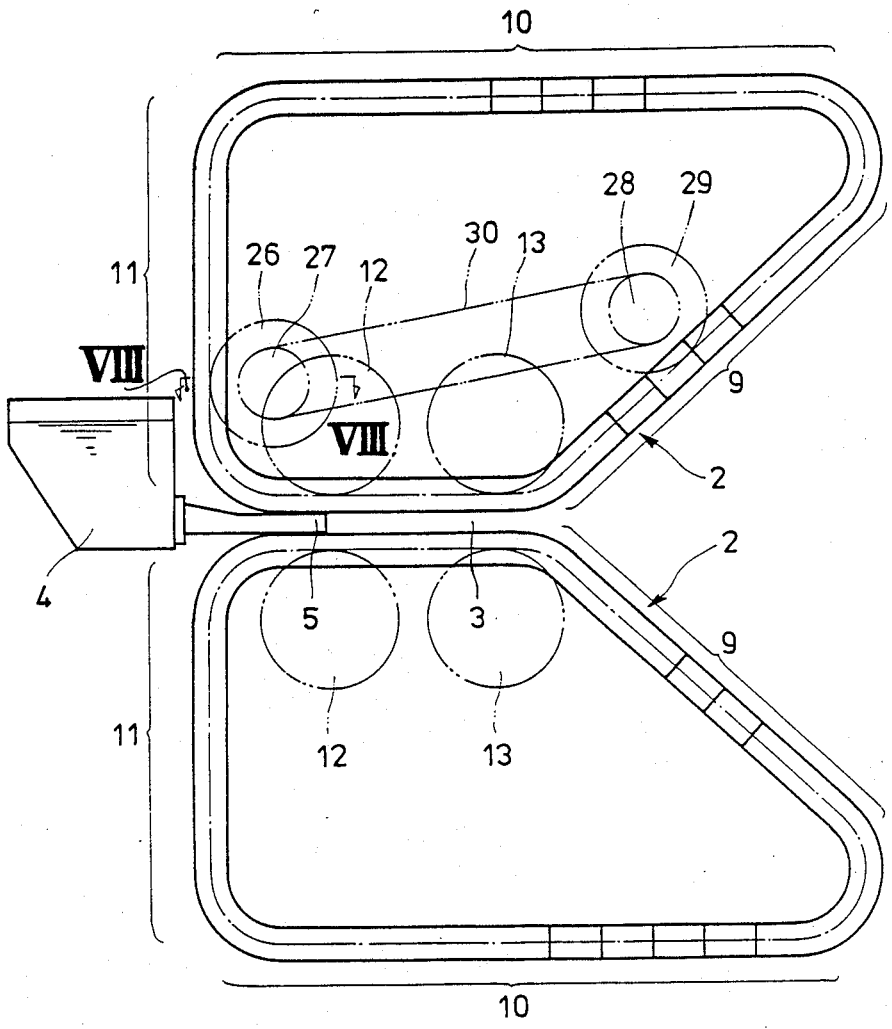
FIG. 7 is a view used to explain an endless track type continuous casting machine in accordance with the present invention.
Figure 8:
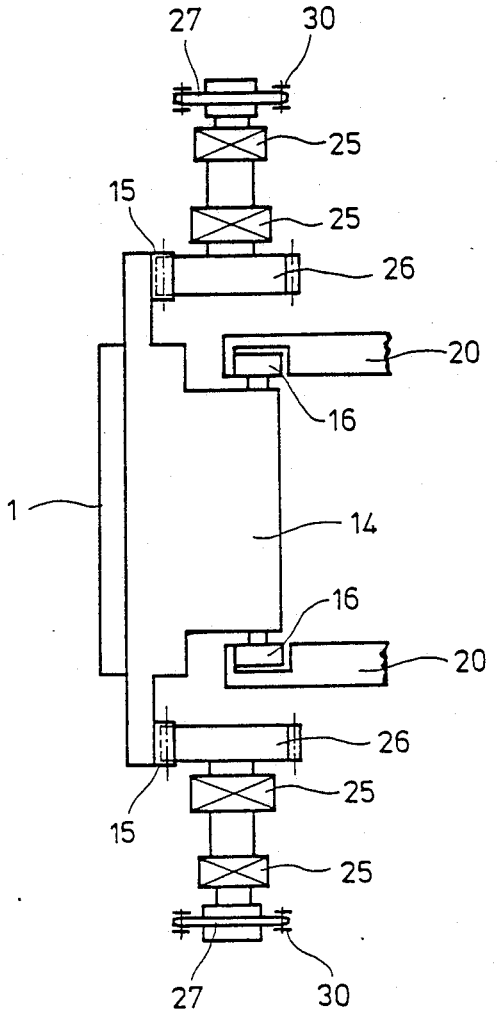
FIG. 8 is a sectional view taken along the line VIII—VIII in FIG. 7.

Referring now to FIGS. 7 and 8, a preferred embodiment of an endless track type continuous casting machine in accordance with the present invention will be described.

A gear 26 supported by bearings 25 as shown in FIG. 8 is disposed at a lower portion of the vertically downward run of the upper mold assembly 2 adjacent to the upstream end of the mold cavity 3 and is in mesh with the rack 15. A sprocket 27 is carried by the shaft of the gear 26.

At the inclined portion adjacent to the downstream end of the mold cavity 3 of the upper mold assembly 2 are disposed a sprocket 28 and a gear 29 carried by a single shaft. The gear 29 is in mesh with the rack 15 while an endless chain 30 drivingly interconnects between the sprockets 27 and 28.

The continuous casting operation with the endless track type continuous casting machine having the above-described construction is carried out in a manner substantially similar to that described above with reference to FIGS. 2–6. When the upper mold assembly 2 above the mold cavity 3 passes along the vertical downward path adjacent to the upstream end of the mold cavity 3, the gears 26 are driven through the rack 15 by the downward force of the upper mold assembly 2. The rotation of the gear 26 is transmitted through the sprocket 27, the endless chain 30, the sprocket 28, the gear 29 and the rack 15 to the block mold 1 of the upper mold assembly 2 passing the inclined path adjacent to the downstream end of the mold cavity 3 and is utilized as the force for pushing up the block mold 1 and its carrier 4 of the upper mold assembly 2 in the inclined path. As a result, the horizontal run of the upper mold assembly 2 which defines the upper casting surface of the mold cavity 3 is prevented from being slacked. Furthermore, no excess forces are exerted to the interfaces between the adjacent block molds 1 of the upper mold assembly which are passing through the mold cavity 3 so that the interfaces between the adjacent block molds 1 are not damaged. Moreover, the moment applied to each carrier 14 is decreased so that a desired degree of flatness of the block molds 1 and their carriers 14 can be maintained. As a consequence, a predetermined cross-sectional configuration of the mold cavity 3 can be maintained with a high degree of dimensional accuracy so that a high-quality casting can be obtained.

According to the endless track type continuous casting machine in accordance with the present invention, the distortion of the mold cavity due to the force resulting from the block molds and their carriers of the upper mold assembly passing the vertical path toward the upstream end of the mold cavity can be prevented. In other words, a predetermined cross-sectional configuration of the mold cavity can be always maintained. Therefore, the present invention can attain a remarkable feature capable of producing a high-quality casting.

What is claimed is:

1. In an endless track type continuous casting machine wherein a pair of upper and lower mold assemblies each comprising a plurality of block molds interconnected through a plurality of carriers are disposed such that opposing surfaces of said upper and lower mold assemblies are driven in a same direction to define a mold cavity, an improvement comprising power transmission means comprising additional gear means for offsetting the downward force resulting from the block mold and its carrier for both downwardly and upwardly directed paths leading to and away from the upstream and downstream ends respectively of said block mold.

2. The machine according to claim 1 wherein said additional gear means comprises a first rotatable gear in mesh with a rack on said carrier of said upper mold assembly passing the downwardly directed path, a second rotatable gear in mesh with the rack on said carrier of said upper mold assembly passing the upwardly directed path extending upwardly from the downstream end of said mold cavity, sprockets coaxially and integrally mounted on shafts of said first and second gears, respectively, and an endless chain for drivingly interconnecting said sprockets.

* * * * *